United States Patent [19]

Varga

[11] 4,085,977

[45] Apr. 25, 1978

[54] FEEDING OF FIBROUS MATERIAL TO CARDING MACHINES

[75] Inventor: John Maximilian Jules Varga, Halifax, England

[73] Assignee: Carding Specialists Co. Limited, England

[21] Appl. No.: 829,953

[22] Filed: Sep. 1, 1977

Related U.S. Application Data

[63] Continuation of Ser. No. 620,348, Oct. 8, 1975, abandoned, which is a continuation of Ser. No. 530,828, Dec. 9, 1974, abandoned, which is a continuation of Ser. No. 426,956, Dec. 13, 1973, abandoned, which is a continuation-in-part of Ser. No. 114,764, Feb. 12, 1971, abandoned.

[30] Foreign Application Priority Data

Feb. 12, 1970 United Kingdom ..... 6818/70

[51] Int. Cl.[2] ..... B65G 53/06

[52] U.S. Cl. ..... 302/28; 19/105; 302/40; 302/59; 302/66

[58] Field of Search ..... 19/97.5, 105; 302/28, 302/36, 38, 40, 52, 56, 59, 66; 251/335 R

[56] References Cited

U.S. PATENT DOCUMENTS

| | | | |
|---|---|---|---|
| 3,414,330 | 12/1968 | Trutzschler | 302/28 |
| 3,552,800 | 1/1971 | Trutzschler | 302/40 |

FOREIGN PATENT DOCUMENTS

| | | |
|---|---|---|
| 973,662 | 10/1964 | United Kingdom. |
| 988,593 | 4/1965 | United Kingdom. |
| 988,594 | 4/1965 | United Kingdom. |

*Primary Examiner*—John J. Love
*Assistant Examiner*—Jeffrey V. Nase
*Attorney, Agent, or Firm*—Bierman & Bierman

[57] ABSTRACT

A method of, and apparatus for, feeding fibrous material to the chute from which a carding machine is fed, wherein fibrous material is entrained in a flow of moving air downstream of the flow generation point, and the flow of air and entrained material is led along a duct to the chute. Desirably, the air flow is not more than 300 cubic feet per minute and is generated by a positive displacement blower.

Additionally, a pivotable valve flap is provided wherein the pivoting means are shielded from the movement of material in the ducts to prevent the formation of trailings on said pivot means.

11 Claims, 5 Drawing Figures

FEEDING OF FIBROUS MATERIAL TO CARDING MACHINES

This is a continuation of copending application Ser. No. 620,348 filed Oct. 8, 1975, now abandoned, which is a continuation of application Ser. No. 530,828 filed Dec. 9, 1974, now abandoned, which in turn is a continuation of application Ser. No. 426,956 filed Dec. 13, 1973, now abandoned, which application is a continuation-in-part of application Ser. No. 114,764, filed Feb. 12, 1971, now abandoned, which application claims the priority of British Application No. 6818/70, filed Feb. 12, 1970.

This invention specifically relates to the feeding of fibrous material to carding machines.

The chute feeding of carding machines is now well known. At the entry side of the carding machine there is positioned a vertical chute extending across the full width of the machine and having a pair of feed rolls at the bottom of the chute. Fibrous material in the chute is fed by the feed rollers in the form of a somewhat compressed web to the feed lattice of the carding machine. Fibrous material is conventionally fed to the chutes through ductwork, or belts, the material being moved through the ductwork by an air flow created by a fan. The ductwork preferably feeds a number of chutes and some form of demand system is provided whereby any chute is refilled when the level of material therein drops below a certain value. In order to ensure a proper flow of material, large fans have been used, giving an air flow of the order of 1600 – 1800 cubic feet per minute (c.f.m.) and the ductwork has been of correspondingly large cross-section. In some known systems the fan draws air into the system and the large volume of air entrains the fibrous material in a more or less uniform suspension before passing through the fan and on through the ductwork into the chutes. In other systems a recirculation arrangement is employed with the fan positioned after the entries to the chutes to draw excess suspended fibrous material past the chutes and return it to the entry point of the system. In each case fibrous material passes through the fan, and the density of the suspended material has to be low so that it may pass through the fan without nepping and fiber damage occurring. To accommodate this diffuse material the ductwork needs to be large with consequent expense and lack of flexibility.

It has long been recognized that the elimination of a lap is desirable in order to reduce damage and labor and to achieve more uniform and controlled quality carding. Two types of systems have been proposed to achieve this, the first being an air feed chute system and the second being a conveyor belt system.

Interestingly, the conveyor system is in reality designed to eliminate the shortcomings of the pneumatic transport system. The reason is that the art tends to believe that pneumatic transport systems cause nepping or cause the card to produce neps while the tufts of cotton move along the chute and that chute fed carding machines do not yield the yarn quality they should. Conveyor belt systems, as the name implies, utilize a moving belt to convey tufts of material to the chutes which feed the carding machines.

According to the present invention, a method of feeding fibrous material to a carding machine comprises introducing the fibrous material into a flow of moving air generated upstream of the material introduction point, and leading the flow of air and entrained material along a duct to a chute.

Apparatus according to the invention comprises means for providing an air flow, means for introducing fibrous material into the air flow downstream of the air flow producing means and a duct for directing the air and entrained material to a chute.

With the method and apparatus of the invention, the fibrous material does not pass through the means providing the air flow, and the volume of air flowing need not be such as to cause the fibrous material to form a relatively uniform suspension in the air flow. Accordingly, the feeding operation may take place with a substantially smaller air flow than hitherto, and the cross-sectional area of the ductwork can correspondingly be much smaller than in conventional arrangements, with consequent lesser expense and as will be described later in this specification, more versatility.

Preferably, the fibrous material passing along the duct is deflected to fall into the chute while the air is allowed to pass out of the chute and the volume of air used is not sufficient to disturb substantially the fibrous material already present in the chute, or to compact this material.

Effective and uniform filling of the chute thus occurs with little disturbance from the air, which may be filtered if required and released from any convenient part of the chute, preferably from the upper end thereof.

Preferably the air flow used in the method of the invention is not more than about 300 c.f.m., the more preferred range being from 60 to 250 c.f.m. and a particularly useful range being from 80 to 150 c.f.m. With both ranges, it is convenient to use ducts having a cross-sectional area of about 12 sq. ins.; with larger air flows the cross-sectional area of the duct can be made larger than this figure.

The means for providing the flow of air is preferably a positive displacement blower, although a fan could be used. If a partial blockage of the duct occurs when a fan is used, the air flow through the duct will gradually lessen and thus a complete blockage can occur. A positive displacement blower will not suffer from this disadvantage, as any blockage of the duct will cause the pressure of air in the duct in advance of the blockage to rise, and the increased pressure forces the blocking material along and from the duct.

In the case of the pneumatic transport systems, the art has assumed that it is essential to the proper operation of the system that the material to be transported be finely divided or comminuted to form a uniform suspension in the ducts. This is generally deemed desirable in order to avoid nep formation during transport to the carding machine and to keep the feed to the carding machine as uniform as possible. The tufts used in the prior art generally weigh between about 5 and 15 milligrams. Even with the air suspended light weight tufts, the art tends to handle the tufts gently and very carefully to avoid nep formation and curling effects during air transport of the tufts through the ducts. One of the approaches currently utilized is a push-pull fan system, i.e., one suction fan and one blower to eliminate rough handling.

For instance, there are many different pneumatic transport units available. Included are the Truetzschler FBK System, the Rieter Aero Feed System, the Platt Brothers Chute Feeding System and the Hergeth Flockfeed Unit. There are other units on the market but these are deemed representative.

In the above units, the tuft weight handled is in the range of about 5 to 15 milligrams. They are all concerned with the possibility of nep formation and damage during movement through the ducts and thereafter. For instance, Rieter supplies its own cotton opening unit to produce the highest degree of opening which can be achieved, producing tufts weighing theoretically 7 - 10 milligrams. The Truetzschler FBK system utilizes tufts of between 5 and 15 milligrams and reduces the nepping problem by using short ducts or pipes to the carding machines and eliminating a tuft return system for excess tufts:

It has been unexpectedly discovered that it is not necessary to keep tuft weight down in order to feed cotton tufts to a carding machine. Surprisingly, it has been discovered that large tufts, or agglomerates, are readily suited to pneumatic feeding systems since the efficiency of the system increases dramatically with an attendant decrease in costs.

In accordance with the present invention, large tufts of fiber are successfully transported through a small cross-section duct. Fiber tufts on the order of 15,000 milligrams have been successfully used with no increase in nep formation over those units utilizing tufts on the order of 5 to 15 milligrams.

It has been further discovered that the use of large agglomerates, or aggregates, of fibers with corresponding small cross-section ducts greatly increases the efficiency of the pneumatic transport system. The small cross-section of the ductwork makes it a quite flexible system since the ducts may now be readily interchanged. For the four systems analyzed with respect to a specific embodiment of the invention, a minimum three-fold increase in fiber throughput was observed per square foot of duct cross-section.

The art generally teaches that agglomeration of tufts, or "clumping," must be avoided. See, for instance, "Die Automation in der Stapelfaserspinnerei" by Dr. H. Keller, Melliand Textilberichte, published October, 1966 (pp. 1089-1101). The present invention depends on "clumped" fibers, or agglomerates, for its operation.

As a specific example, it has been discovered that a duct having a cross-section of 0.083 square feet, using agglomerates, preferably will deliver 6,000 pounds of material per square foot of duct cross-section per hour at a 500 pound per hour rate of material flow. At 250 pounds per hour, the apparatus will put through about 3,000 pounds of material per square foot of cross-section assuming an air flow rate of about 250 c.f.m. in the first instance and about 150 c.f.m. in the second. In contrast, three other systems, namely the Platt, Rieter and Hergeth pneumatic transport systems, will all deliver less than 2,000 pounds per square foot of duct cross-section per hour.

The following table compares the instant invention to three other units now on the market.

| | Rated Load | Ductax-Section | Minimum air-flow rate/ pound deliv-ered/ft.$^3$ | Lbs. material per sq. ft./hr. |
|---|---|---|---|---|
| Reiter Aero Feed System | 1000 lb./hr. | 0.765→1.75 | 0.0083 | 1480 |
| Platt Bros. System | 1000 lb./hr. | 0.55 | 0.0083 | 1850 |
| Hergeth Flockfeed | 1000 lb./hr. | 1.0 | 0.00555 | 1000 |
| Present Invention | 500 lb./hr. | 0.083 | 0.033 | 6000 |
| Present Invention | ½ load | 0.083 | 0.028 | 3000 |
| Present Invention | 200 lb./hr. | 0.083 | 0.022 | 2400 |

-continued

The comparisons in the above table were made at rated output in pounds per hour for each unit. At half load, the pound delivered per cubic foot figure in the table will decrease by a factor of two. For example, the Rieter system figure would drop from 0.0083 to 0.0042, clearly significantly different from the 0.028 figure of the instant invention.

In comparing the present invention to the others by increasing the output to 1,000 pounds per hour at the same airflow rate, the present invention will yield a figure of 0.066, also clearly different from the unit used in the comparison above. Of course, if air flow in each unit is increased or decreased in accordance with an equal change in material throughput, then the pounds per cubic foot of air figure will remain approximately the same. For instance, if 1,000 pounds per hour was selected as the throughput in the present invention with an air flow of 500 c.f.m., the pounds per cubic foot ratio would remain the same. Of course, it is not necessary to use such high flow rates in the present invention to achieve a throughput of 1,000 pounds per hour, and it has been discovered that the use of about 250 c.f.m. will perform adequately.

Quite clearly, the use of agglomerates gives unexpectedly superior results in amount of material moved through the ducts with a much smaller duct and much lower power requirement. Most importantly, the apparatus of the instant invention does not increase nepping and, as is quite evident, cannot and does not handle the transported fiber gently. If anything, the handling is rather rough and yet, contrary to the teachings of the art, nepping and fiber damage do not occur in any greater degree than that experienced by prior art pneumatic transport systems.

In order to achieve the benefits of the instant invention, it is not important that the fiber be opened up. The tufts, or agglomerates, thus formed must, however, be pushed or pulled along the ducts, rather than carried in suspension. Any definition of the instant invention must be in relation to three factors — duct cross-section, air flow rate and agglomerate weight or size. These factors are closely interrelated and cannot be divorced from each other. For given agglomerate weight, the duct size must be large enough to accommodate the agglomerates, yet small enough to preclude an excessive use of air. In addition, the air flow rate should be sufficient to move the agglomerates.

For best results, the velocity of air through the ducts should equal or exceed about 1,000 feet per minutes (12 sq. inch. duct at 80 c.f.m.) In order to obtain the benefits of high material throughput using low air volume, the cross-sectional area of the system ductwork should not exceed about 25 square inches and the material throughput should be at least about 0.022 pounds per cubic foot of air used.

In essence, the agglomerates are compacted or condensed fibers and are not as readily subject to damage. More importantly it has been found that uniform feed of material to the chute is not necessary to achieve high quality yarn from the carding machine, as taught by the art. The agglomerates of the instant invention are anything but uniform and will not uniformly fill the chutes. Yet, this does not affect performance of the carding machine or quality of yarn.

In addition to the foregoing, the low air flow rates (30 cubic feet per pound in the example given above) permit the dissipation of spent air through the chutes themselves by use of a filter screen in the chutes. In contrast, conventional systems use about 120 cubic feet per pound of material.

Pneumatic transport systems generally use valves to control the flow of material to the chutes. The valves generally consist of flaps adapted to cover a chute whenever it is desired to cut the flow of material to the particular chute.

In the past, the flaps were mounted on cylindrical elements about which the flaps pivoted to open or close off the chute. The material being moved along the ducts often snagged on the flaps. Materials such as cotton tend to agglomerate and before long, a trailing, i.e., long strand of cotton, would begin to develop in the ducts with its roots at the flap. These trailings would continue to build until it became necessary to physically remove them from the ducts. The trailings interfered with flap movement and the machinery often had to be shut down in order to permit their removal.

In accordance with another aspect of the instant invention, the member about which the flap pivots is closed to the air flow in the ducts. This may be achieved through use of flexible members positioned on both sides of the flap and connected to the ductwork. By this closing off the flap pivoting control, cotton or other material will not readily be able to snag in the area of the flaps, thus tending to eliminate the formation of trailings in the region of the flap.

Embodiments of the invention will now be described in more detail, by way of example only, with reference to the accompanying drawings in which.

Figure 1:
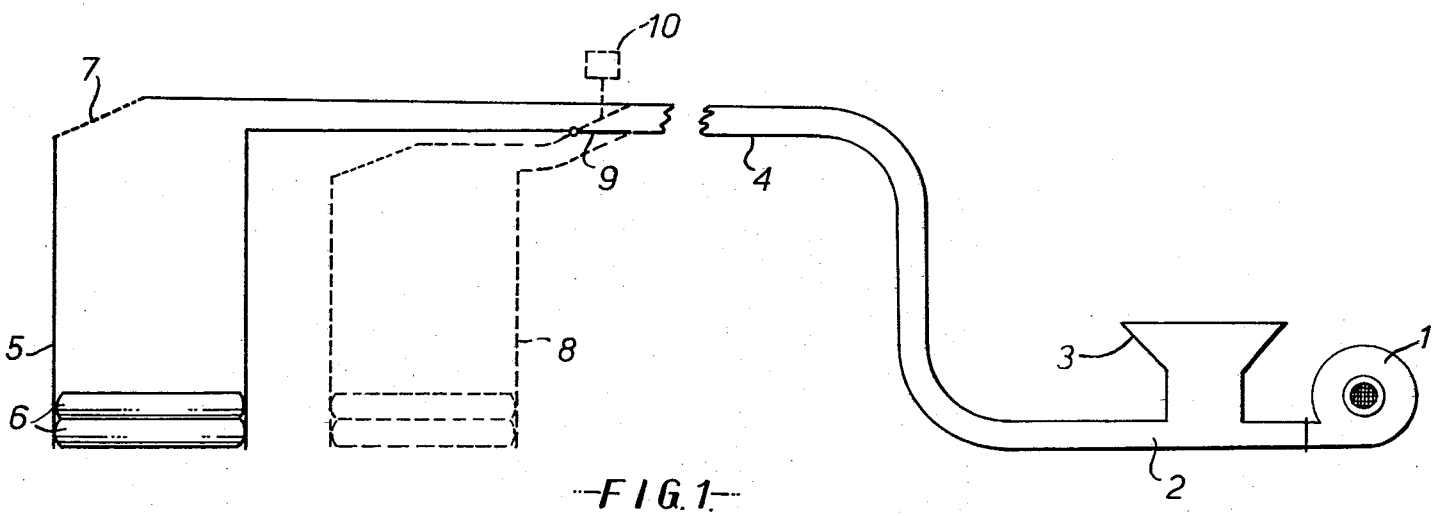
FIG. 1 is a schematic elevation of apparatus for carrying out the invention.

As shown in FIG. 1, the apparatus comprises a positive displacement blower 1 taking in atmospheric air through a filter and blowing the air along a conduit 2 to a feed device 3, of any form which will feed agglomerated material to the duct 4. Ductwork 4 leads from the device 3 to a chute 5 having rollers 6 at its lower opening to feed material from the chute in web form to the feed lattice of a carding machine. The ductwork 4 opens into the upper end of the chute and material conveyed along the duct impinges on a downwardly inclined perforated filter plate 7 and falls freely into the chute. The air conveying the agglomerated material passes through the filter plate 7 and so leaves the chute. The chute may have a rear wall capable of being oscillated forwards and backwards to assist uniform packing of the agglomerated material in the chute.

Excellent results have been obtained with this apparatus feeding material in air flows of 80 c.f.m. and 150 c.f.m. through ductwork having a rectangular cross-section measuring 4 by 3 inches or 0.083 square feet in cross-section. The fibrous material travels in aggregates and on hitting the filter plate 7 falls freely into the chute. There is little disturbance of the material in the chute by the air, and little tendency for the air to cause packing of the material in the chute due to the extremely low volume of air. Partial blockages of the duct are rare; when a blockage has occurred, the increasing air pressure behind the blocking material has blown this free. If the ductwork is built up in sections, as is preferred, care must be taken to effect a seal between adjacent sections to stop any leakage and thus allow the pressure to build up to clear any blockage. Although good results are obtained at air flow rates lower than 150 c.f.m., when using a 12 square inch cross-section duct, the flow rate should be 150 c.f.m. or greater.

At 150 c.f.m. this apparatus is capable of conveying 200–250 lbs. of fiber per hour and so is capable of feeding a number of chutes on a demand system. At 250 c.f.m., the apparatus is capable of delivering 500 pounds of material per hour, or 6,000 pounds per square foot of duct cross-section. FIG. 1 shows in broken lines a second chute 8 being fed from the same ductwork. Material can be deflected into the second chute by a flap 9 pivoted in the duct and capable of pivoting to direct material either along the main duct or into a branch duct leading to chute 8. A solenoid mechanism 10 may control the flap 9, the solenoid mechanism and the feed device 3 both being controlled by a demand system responsive to the level of fibrous material in the two chutes to feed material to either chute when necessary.

Figure 2:
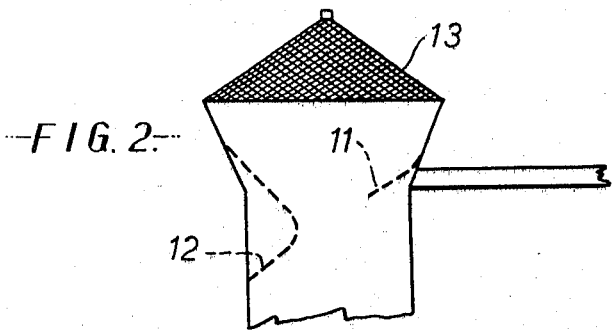
FIG. 2 shows an alternative form of part of the apparatus.

FIG. 2 shows an alternative arrangement for the upper end of the chute. The chute has a downwardly angled deflector plate 11 at the entry side thereof, and further directing means 12 secured to the opposite wall. A space is left between the plate 11 and means 12. The top of the chute is outwardly flared, and the open top is covered by a filter cloth 13 held by means, not shown, to take the form of an inverted "V." Air bringing the material into the chute leaves the chute through the filter cloth. The means holding the filter cloth may be designed to be rapidly lowered and raised again at intervals to shake free accumulated material from the cloth and so prevent this from clogging.

Figure 3:
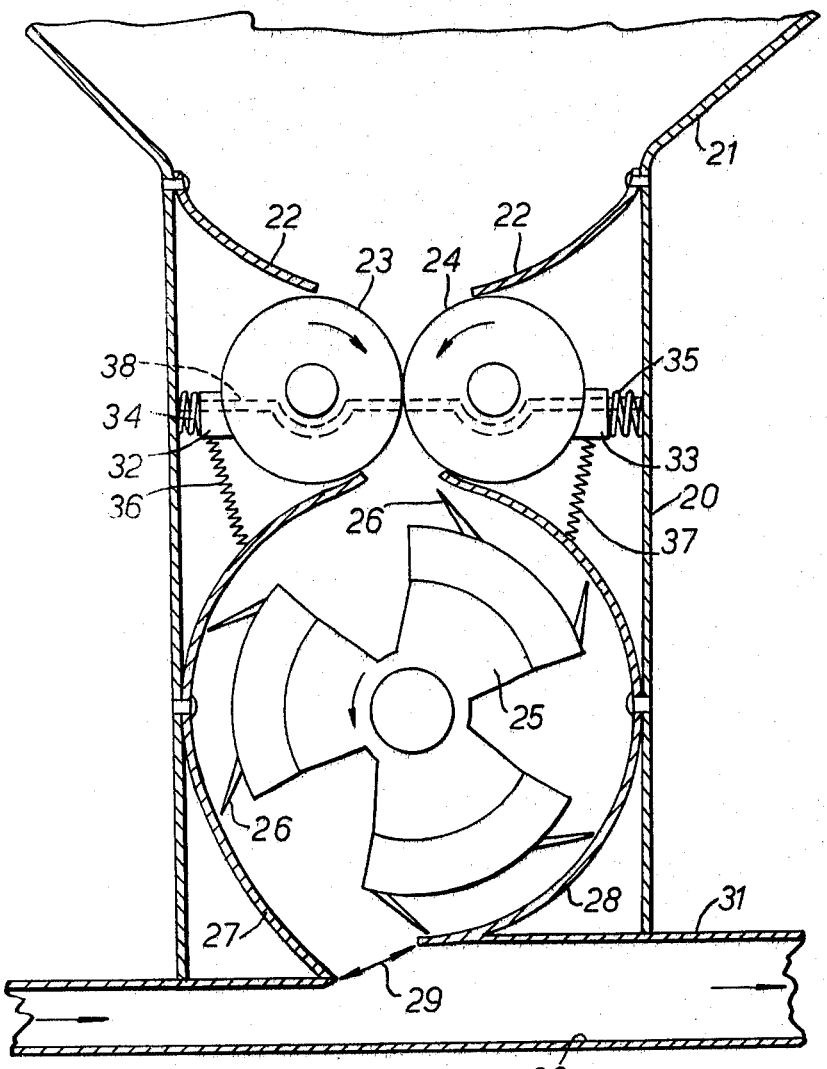
FIG. 3 is a cross-section through part of the apparatus shown in FIG. 1.

FIG. 3 shows in more detail one form of feed device for introducing fibrous material into the air flow. The device comprises a casing 20 having a flared material receiving upper part 21. The base of this upper part 21 is formed by inclined plates 22 having a space between them which allows the material to rest on the upper parts of the peripheries of two feed rollers 23 and 24 journalled for rotation in the casing. Positioned below the feed rollers 23 and 24 is an opening roller 25 having spikes 26 projecting from the surface thereof, for example, a Kirschner roller would be suitable. Guard and guide plates 27 and 28 surround much of the periphery of the roller 25, spaces being left only below the nip of feed rollers 23 and 24 and at the bottom of the roller 25. This bottom space 29 opens into a duct 30 leading from the positive displacement blower 1, the duct being shaped in the region of the space 29 to form a backward facing step so that the fibrous material will be transferred from the spikes 26 into the air flow and carried by the air to ductwork connected to the duct section 31.

Means (not shown) are provided for biasing the feed rollers towards each other. Sealing pads 32 and 33 respectively are biased against the feed rollers 23 and 24 by springs 34 and 35, and corrugated air-proof sections 36 and 37 extend from the pads 32 and 33 to the guards 27 and 28 respectively. Sealing plates, such as 38, bear against the axial ends of the rollers 23 and 24, and a rotary seal is formed around the shaft of roller 25. These measures combine to reduce or prevent any escape of air from the duct 30 upwardly through the feed device. The rollers 23 to 25 may be driven through gearing from a common motor mounted on the casing. It will readily be seen that when the rollers are driven, the feed rollers 23 and 24 carry material from the hopper down to the roller 25, which carries the material on to be entrained in the air stream.

The material in the hopper may be in any suitable form. It may be particularly advantageous to load the hopper with a preformed lap of the material, which can be handled relatively easily and dealt with by the rollers without any problem. Alternatively, the hopper may be fed directly from a bale opening or fiber blending machine, or may be fed with opened fiber which has been stored in any convenient manner.

The feed device shown in FIG. 3 is, of course, only exemplary, and other forms of feed device could readily be used. In particular, the opening roller 25 may be omitted and the feed rollers 23 and 24 may then feed ready opened fiber directly into the air stream.

Figure 4:
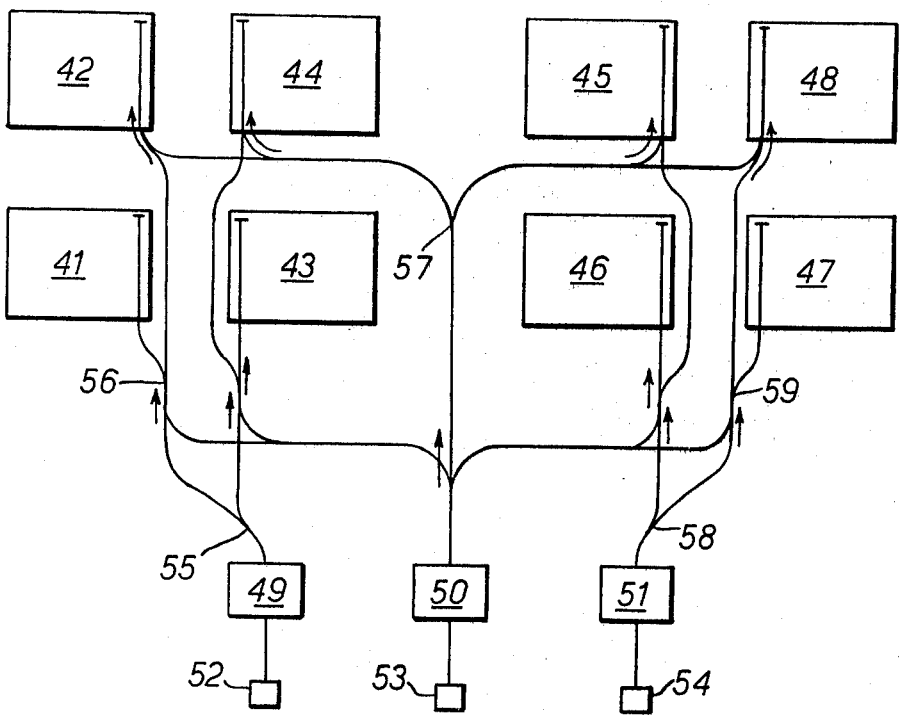
FIG. 4 is a schematic layout of a system according to the invention.

FIG. 4 shows an arrangement wherein the feed system of the invention is used to feed the chutes associated with eight carding machines 41 to 48. The chutes are linked by ductwork with feeding devices 49 to 51 having associated positive displacement blowers 52 to 54, each blower and feed device having the capacity to feed sufficient material per hour to supply three chutes on an alternative demand basis. The ductwork is conveniently substantially 12 sq. in. in cross-sectional area and may be circular or rectangular. It may usefully be built up from sections, which may be made by extruding plastics material, the joint between adjacent sections being sealed. Sharp corners in the ductwork are, desirably, avoided. The ductwork includes a number of junctions, each of which may be of simple pivoted flap form, for controlling the path taken by the agglomerated material from any particular one of the feed devices. Each junction may be controlled by pneumatic, mechanical or electrical means either automatically or manually or by a combination of both.

As an example of the use of this system, suppose that the five carding machines 41 to 45 are to be run with one particular type of fiber and the other three machines 46 to 48 are to be run with a different type of fiber. Machines 41 to 43 are to be fed from feed device 49; machines 44 and 45 from feed device 50 (supplied with the same material as device 49) and machines 46 to 48 from feed device 51 (supplied with a different material to device 49). Accordingly, certain junctions are pre-set and locked to allow flow in the directions indicated by the arrows. Any junction without a corresponding arrow is not locked.

Photoelectric cells responsive to the level of material in the chutes of machines 41 to 43 then control junctions 55 and 56 so that the feed device 49 delivers material as required to the machines 41 to 43. Photoelectric cells in the chutes of machines 44 and 45 control junction 57 so that the device 50 supplies the chutes of machines 44 and 45 as needed. Photoelectric cells in the chutes of machines 45 to 48 control junctions 58 and 59 so that the device 51 feeds material to the chutes of machines 45 to 48 as necessary. The photoelectric cells also control the motors of the feed devices so that these only run when there is a demand for material from one or other of the carding machines.

It will be seen that when a required run of material is completed, the states of the junctions can readily be changed to re-program the system to work in any other desired manner. Thus, different types of material can be processed at the same time by carding machines fed from a common location, and the type of material and number of cards dealing with any type can be changed very simply. Because of the relative cheapness, small size and light weight of the ductwork, a relatively complex permanent installation such as that shown in FIG. 4 can be utilized. Alternatively, sections of ductwork can easily be removed and fitted elsewhere to build up a different feed pattern to any given set of carding machines.

Figure 5:
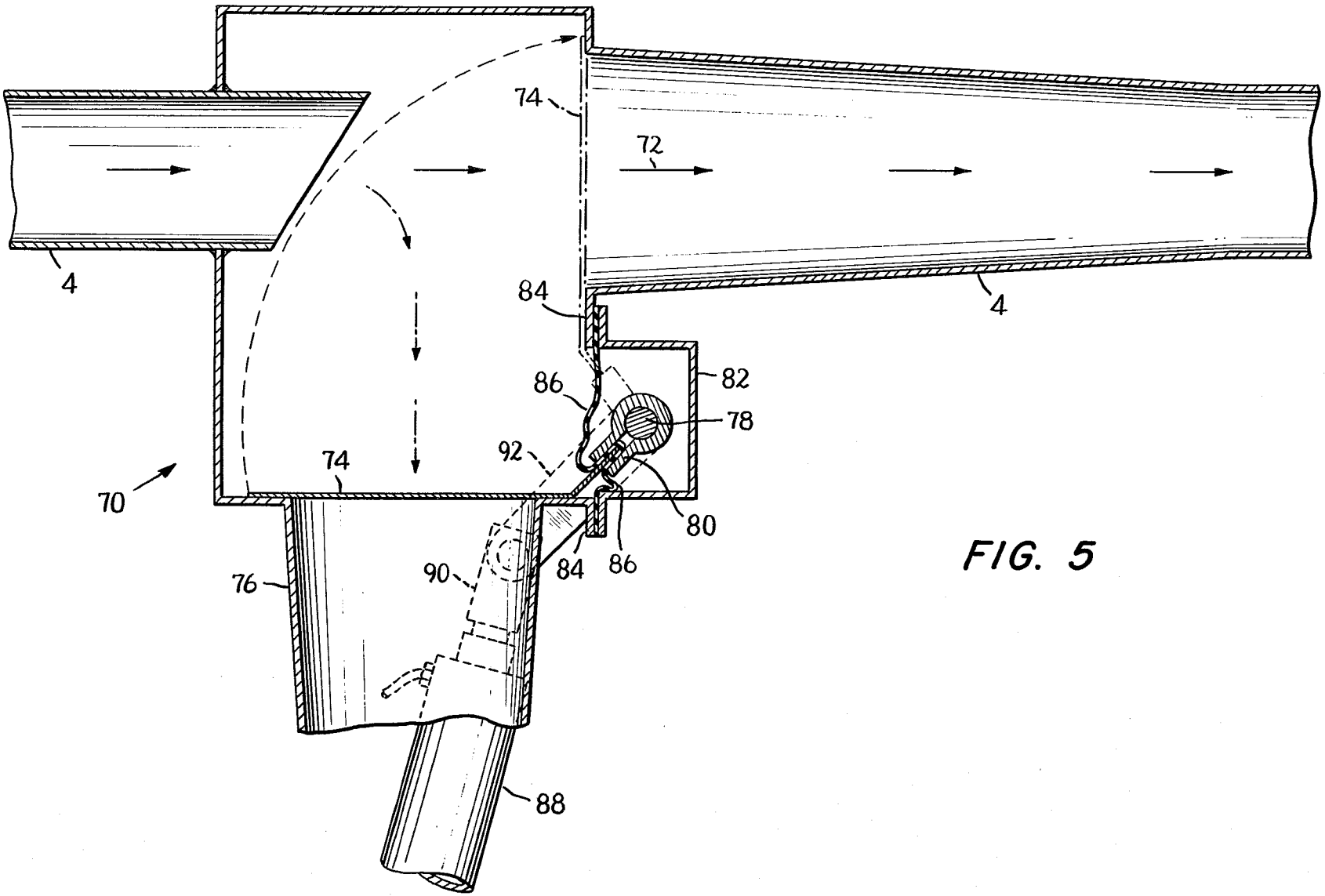
FIG. 5 is a cross-section of a valve for controlling material flow.

Referring now to FIG. 5, a pneumatic two-way distributor valve, denoted generally by the numeral 70, is shown positioned in duct 4. The valve 70 is shown in a duct adapted to feed another chute (not shown) positioned downstream of the valve. Material flow in this embodiment is in the direction of the arrow 72.

Positioned below the level of duct 4 is a flap 74. In the position shown, flap 74 covers duct 76 which in turn feeds a chute (not shown). In this position of the flap, material moving in duct 4 will be prevented from entering duct 76 and will instead continue on to the next chute (not shown).

Flap 74 is mounted to cylindrical pivot 78 by a conventional C-clamp 80. Pivot 78 is journalled conventionally in the sides of cover 82. Mounted between cover 82 and the wall of the duct at 84 are two covers 86, made of a flexible material such as rubber. The covers are also mounted in the C-clamp 80. In this manner, pivot 78 is closed to the material moving in duct 4 when flap 74 is removed to its dotted line position to permit the entry of material into duct 76 and the chute below it. As can readily be appreciated, cotton or other material moving in the duct will not be able to snag or catch on the pivot, thereby tending to decrease the formation of trailings in the region of the flap.

Flap 74 may be moved between its full and dotted line positions by a conventional pneumatic cylinder 88. Cylinder 88, as shown in FIG. 5, has extensible rod 90 to which another arm 92 is pivotally mounted. Arm 92, in turn, fixedly mounted to pivot 78 in conventional fashion so that extension of rod 90 will cause rotation of pivot 78 to rotate flap 74. In the full line position of flap 78, material moving the duct will not be permitted to enter the chute. In the dotted line position of the flap, material moving in the duct will be deflected into the chute.

Of course, the flexible material 86 need not be connected to the C-clamp as shown. It may, for instance, be glued on the flap 74 or secured thereto in some other manner. The method shown, however, is preferred since it presents a smooth surface to the moving material.

The versatility of the feed system made possible by the invention will now be evident.

What is claimed is:

1. A method for feeding agglomerated fibrous material to a chute for feeding a carding machine through at least one duct having a preselected cross sectional area comprising the steps of generating a flow of moving air in said duct, preselecting the air flow rate and feeding said material at a selected rate to provide not less than 0.022 pounds of said material per cubic foot of air used, whereby said cross sectional area, said air flow rate and said feeding rate are selected so that said material is pushed or pulled along said duct and not suspended.

2. The method specified in claim 1 wherein said air flow rate is at least 1,000 linear feet per minute.

3. The method specified in claim 1, wherein said duct cross sectional area is less than about twenty five square inches.

4. The method specified in claim 3 wherein said duct cross sectional area is about twelve square inches.

5. The method specified in claim 4 wherein said air flow rate is 250 c.f.m. and said flow rate is at least 0.033 pounds per cubic foot of flowing air.

6. The method specified in claim 1 wherein said air flow rate is about 1800 linear feet per minute, said duct cross sectional area is twelve square-inches and said material flow rate is about 0.022 pounds per cubic foot of flowing air.

7. The method specified in claim 1 wherein said flow of moving air is a positive flow of air.

8. The method specified in claim 1 wherein said agglomerated material weighs about 15,000 milligrams.

9. A method as claimed in claim 1 wherein said material passing along the duct is deflected to fall into said chute while said air is allowed to pass out of said chute, and the volume of air used is not sufficient to disturb material already present in said chute.

10. In a pneumatic transport system of the type having at least one chute and a duct for feeding fibrous material to said chute comprising a flap mounted in a C-clamp, means for pivotally mounting said flap inside said duct for pivoting between a first position in which said flap is positioned to deflect said material into said chute and a second position in which said flap is positioned to close said chute to said material, said means for pivotally mounting said flap comprises a pivot pin, said C-clamp being fixedly mounted to said pivot pin, and at least one flexible member mounted in said duct for covering said means for pivotally mounting said flap to prevent the entry of said fibrous material to said means for pivotally mounting said flap.

11. The apparatus specified in claim 10 wherein there are two said flexible members one end of each flexible member being mounted between said flap and said C-clamp on opposite sides of said flap.

* * * * *